US008462180B2

(12) United States Patent
Weitbruch et al.

(10) Patent No.: US 8,462,180 B2
(45) Date of Patent: Jun. 11, 2013

(54) METHOD FOR GRAYSCALE RENDITION IN AN AM-OLED

(75) Inventors: Sebastien Weitbruch, Kappel (DE); Carlos Correa, Villingen-Schwenningen (DE); Cedric Thebault, Villingen-Schwenningen (DE)

(73) Assignee: Thomson Licensing, Boulogne-Billancourt (FR)

( * ) Notice: Subject to any disclaimer, the term of this patent is extended or adjusted under 35 U.S.C. 154(b) by 1186 days.

(21) Appl. No.: 12/308,788

(22) PCT Filed: Jun. 26, 2007

(86) PCT No.: PCT/EP2007/056386

§ 371 (c)(1),
(2), (4) Date: Dec. 23, 2008

(87) PCT Pub. No.: WO2008/000751

PCT Pub. Date: Jan. 3, 2008

(65) Prior Publication Data

US 2009/0309902 A1 Dec. 17, 2009

(30) Foreign Application Priority Data

Jun. 30, 2006 (EP) ..... 06300743
Oct. 19, 2006 (EP) ..... 06301063

(51) Int. Cl.
*G09G 5/10* (2006.01)

(52) U.S. Cl.
USPC ..... 345/690; 345/602; 345/589; 345/692

(58) Field of Classification Search
USPC ..... 345/60, 589, 690, 692
See application file for complete search history.

(56) References Cited

U.S. PATENT DOCUMENTS

| | | | | |
|---|---|---|---|---|
| 7,280,103 | B2 | 10/2007 | Taoka et al. | |
| 2003/0137521 | A1 * | 7/2003 | Zehner et al. | 345/589 |
| 2003/0206185 | A1 * | 11/2003 | Thebault et al. | 345/690 |
| 2004/0145597 | A1 | 7/2004 | Ito | |
| 2004/0155894 | A1 * | 8/2004 | Van Dijk | 345/692 |

(Continued)

FOREIGN PATENT DOCUMENTS

| | | |
|---|---|---|
| CN | 1110789 | 10/1995 |
| CN | 1447307 | 10/2003 |

(Continued)

OTHER PUBLICATIONS

Search Report Dated Sep. 5, 2007.

*Primary Examiner* — Amare Mengistu
*Assistant Examiner* — Premal Patel
(74) *Attorney, Agent, or Firm* — Tutunjian & Bitetto, P.C.

(57) ABSTRACT

The present invention relates to an apparatus for displaying an input picture of a sequence of input pictures during a video frame made up of N consecutive sub-frames, with N≧2, comprising an active matrix comprising a plurality of light emitting cells, encoder for encoding the video data of each pixel of the input picture to be displayed and delivering N sub-frame data, each sub-frame data being displayed during a sub-frame, a driving unit for selecting row by row the cells of said active matrix and converting, sub-frame by sub-frame, the sub-frame data delivered by said encoder into signals to be applied to the selected cells of the matrix.

According to the invention, at least one of the N sub-frame data generated for a pixel is different from the video data of said pixel.

10 Claims, 9 Drawing Sheets

U.S. PATENT DOCUMENTS

| | | | | |
|---|---|---|---|---|
| 2005/0069209 | A1* | 3/2005 | Damera-Venkata et al. | 382/204 |
| 2005/0253785 | A1 | 11/2005 | Miyasaka et al. | |
| 2007/0120868 | A1 | 5/2007 | Baek | |
| 2009/0174810 | A1* | 7/2009 | Endo et al. | 348/390.1 |

FOREIGN PATENT DOCUMENTS

| | | |
|---|---|---|
| EP | 0618562 | 5/1994 |
| EP | 0762374 | 3/1997 |
| EP | 1591992 | 11/2005 |
| JP | 63182695 | 7/1988 |
| JP | 2004240317 | 8/2004 |
| JP | 2004333911 | 11/2004 |
| JP | 2005241932 | 9/2005 |
| JP | 2007148400 | 6/2007 |

* cited by examiner

METHOD FOR GRAYSCALE RENDITION IN AN AM-OLED

This application claims the benefit, under 35 U.S.C. §365 of International Application PCT/EP2007/056386, filed Jun. 26, 2007, which was published in accordance with PCT Article 21(2) on Jan. 3, 2008 in English and which claims the benefit of European patent application No. 06300743.9, filed Jun. 30, 2006 and European patent application No. 06301063.1, filed 19 Oct. 2006.

FIELD OF THE INVENTION

The present invention relates to a grayscale rendition method in an active matrix OLED (Organic Light Emitting Display) where each cell of the display is controlled via an association of several Thin-Film Transistors (TFTs). This method has been more particularly but not exclusively developed for video application.

BACKGROUND OF THE INVENTION

The structure of an active matrix OLED or AM-OLED is well known. It comprises:

an active matrix containing, for each cell, an association of several TFTs with a capacitor connected to an OLED material; the capacitor acts as a memory component that stores a value during a part of the video frame, this value being representative of a video information to be displayed by the cell during the next video frame or the next part of the video frame; the TFTs act as switches enabling the selection of the cell, the storage of a data in the capacitor and the displaying by the cell of a video information corresponding to the stored data;

a row or gate driver that selects row by row the cells of the matrix in order to refresh their content;

a data or source driver that delivers the data to be stored in each cell of the current selected row; this component receives the video information for each cell; and a digital processing unit that applies required video and signal processing steps and that delivers the required control signals to the row and data drivers.

Actually, there are two ways for driving the OLED cells. In a first way, digital video information sent by the digital processing unit is converted by the data drivers into a current whose amplitude is proportional to the video information. This current is provided to the appropriate cell of the matrix. In a second way, digital video information sent by the digital processing unit is converted by the data drivers into a voltage whose amplitude is proportional to the video information. This current or voltage is provided to the appropriate cell of the matrix.

From the above, it can be deduced that the row driver has a quite simple function since it only has to apply a selection row by row. It is more or less a shift register. The data driver represents the real active part and can be considered as a high level digital to analog converter. The displaying of video information with such a structure of AM-OLED is the following. The input signal is forwarded to the digital processing unit that delivers, after internal processing, a timing signal for row selection to the row driver synchronized with the data sent to the data drivers. The data transmitted to the data driver are either parallel or serial. Additionally, the data driver disposes of a reference signaling delivered by a separate reference signaling device. This component delivers a set of reference voltages in case of voltage driven circuitry or a set of reference currents in case of current driven circuitry. Usually the highest reference is used for the white and the lowest for the smallest gray level. Then, the data driver applies to the matrix cells the voltage or current amplitude corresponding to the data to be displayed by the cells.

Independently of the driving concept (current driving or voltage driving) chosen for the cells, the grayscale level is defined by storing during a frame an analog value in the capacitor of the cell. The cell keeps this value up to the next refresh coming with the next frame. In that case, the video information is rendered in a fully analog manner and stays stable during the whole frame. This grayscale rendition is different from the one in a CRT display that works with a pulse. FIG. 1 illustrates the grayscale rendition in the case of a CRT and an AM-OLED.

FIG. 1 shows that in the case of CRT display (left part of FIG. 1), the selected pixel receives a pulse coming from the beam and generating on the phosphor of the screen a lighting peak that decreases rapidly depending on the phosphor persistence. A new peak is produced one frame later (e.g. 20 ms later for 50 hz, 16.67 ms later for 60 Hz). In this example, a level L1 is displayed during the frame N and a lower level L2 is displayed during a frame N+1. In case of an AMOLED (right part of FIG. 1), the luminance of the current pixel is constant during the whole frame period. The value of the pixel is updated at the beginning of each frame. The video levels L1 and L2 are also displayed during the frames N and N+1. The illumination surfaces for levels L1 and L2, shown by hatched areas in the figure, are equal between the CRT device and the AM-OLED device if the same power management system is used. All the amplitudes are controlled in an analog way.

The grayscale rendition in the AM-OLED introduces some artifacts. One of them is the rendition of low grayscale level rendition. FIG. 2 shows the displaying of the two extreme gray levels on a 8-bit AM-OLED. This figure shows the difference between the lowest gray level produced by using a data signal $C_1$ and the highest gray level (for displaying white) produced by using a data signal $C_{255}$. It is obvious that the data signal $C_1$ must be much lower than $C_{255}$. $C_1$ should normally be 255 times as low as $C_{255}$. So, $C_1$ is very low. However, the storage of such a small value can be difficult due to the inertia of the system. Moreover, an error in the setting of this value (drift . . . ) will have much more impact on the final level for the lowest level than for the highest level.

Another problem of the AM-OLED appears when displaying moving pictures. This problem is due to the reflex mechanism, called optokinetic nystagmus, of the human eyes. This mechanism drives the eyes to pursue a moving object in a scene to keep a stationary picture on the retina. A motion-picture film is a strip of discrete still pictures that produces a visual impression of continuous movement. The apparent movement, called visual phi phenomenon, depends on persistence of the stimulus (here the picture). FIG. 3 illustrates the eye movement in the case of the displaying of a white disk moving on a black background. The disk moves towards left from the frame N to the Frame N+1. The brain identifies the movement of the disk as a continuous movement towards left and creates a visual perception of a continuous movement. The motion rendition in an AM-OLED conflicts with this phenomenon, unlike the CRT display. The perceived movement with a CRT and an AM-OLED when displaying the frame N and N+1 of FIG. 3 is illustrated in FIG. 4. In the case of a CRT display, the pulse displaying suits very well to the visual phi phenomenon. Indeed, the brain has no problem to identify the CRT information as a continuous movement. However, in the case of the AM-OLED picture rendition, the object seems to stay stationary during a whole frame before jumping to a new position in the next frame. Such a movement is quite difficult to be interpreted by the brain that results in either blurred pictures or vibrating pictures (judder).

The international patent application WO 05/104074 in the name of Deutsche Thomson-Brandt Gmbh discloses a method for improving the grayscale rendition in an AM-OLED when displaying low grayscale levels and/or when displaying moving pictures. The idea is to split each frame into a plurality of subframes wherein the amplitude of the signal can be adapted to conform to the visual response of a CRT display.

In this patent application, the amplitude of the data signal applied to the cell is variable during the video frame. For example, this amplitude is decreasing. To this end, the video frame is divided in a plurality of sub-frames $SF_i$ and the data signal which is classically applied to a cell is converted into a plurality of independent elementary data signals, each of these elementary data signals being applied to the cell during a sub-frame. The duration $D_i$ of the different sub-frames can also be variable. The number of sub-frames is higher than two and depends on the refreshing rate that can be used in the AMOLED. The difference with the sub-fields in plasma display panels is that the sub-frames are analog (variable amplitudes) in this case.

FIG. 5 shows the division of an original video frame into 6 sub-frames $SF_0$ to $SF_5$ with respective durations $D_0$ to $D_5$. Six independent elementary data signals $C(SF_0)$, $C(SF_1)$, $C(SF_2)$, $C(SF_3)$, $C(SF_4)$ and $C(SF_5)$, are used for displaying a video level respectively during the sub-frames $SF_0$, $SF_1$, $SF_2$, $SF_3$, $SF_4$ and $SF_5$. The amplitude of each elementary data signal $C(SF_i)$ is either $C_{black}$ or higher than $C_{min}$. $C_{black}$ designates the amplitude of the elementary data signal to be applied to a cell for disabling light emission and $C_{min}$ is a threshold that represents the signal amplitude value above which the working of the cell is considered as good (fast write, good stability . . . ). $C_{black}$ is lower than $C_{min}$. In this figure, the amplitude of the elementary data signals decreases from the first sub-frame to the sixth sub-frame. As the elementary data signals are based on reference voltages or reference currents, this decrease can be carried out by decreasing the reference voltages or currents used for these elementary signals.

The object of the invention is to propose a display device having an increased bit depth. The video data of the input picture are converted into N sub-frame data by a sub-frame encoding unit and then each sub-frame data is converted into an elementary data signal. According to the invention, at least one sub-frame data of a pixel is different from the video data of said pixel.

The invention relates to an apparatus for displaying an input picture of a sequence of input pictures during a video frame made up of N consecutive sub-frames, with $N \geqq 2$, comprising an active matrix comprising a plurality of light emitting cells, encoding means for encoding the video data of each pixel of the input picture to be displayed and delivering N sub-frame data, each sub-frame data being displayed during a sub-frame, and a driving unit for selecting row by row the cells of said active matrix, converting, sub-frame by sub-frame, the sub-frame data delivered by said encoding means into signals to be applied to the selected cells of the matrix.

According to the invention, at least one of the N sub-frame data generated for a pixel is different from the video data of said pixel.

Other features are defined in the appended dependent claims.

BRIEF DESCRIPTION OF THE DRAWINGS

Exemplary embodiments of the invention are illustrated in the drawings and in more detail in the following description.

In the figures.

DESCRIPTION OF PREFERRED EMBODIMENTS

Figure 1:
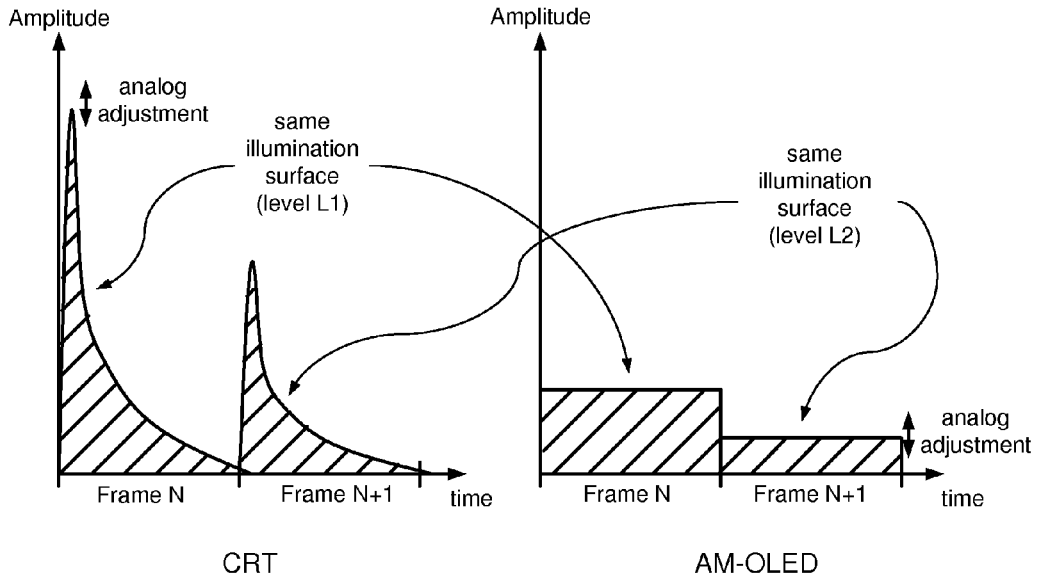
FIG. 1 shows the illumination during frames in the case of a CRT and an AM-OLED.
Figure 2:
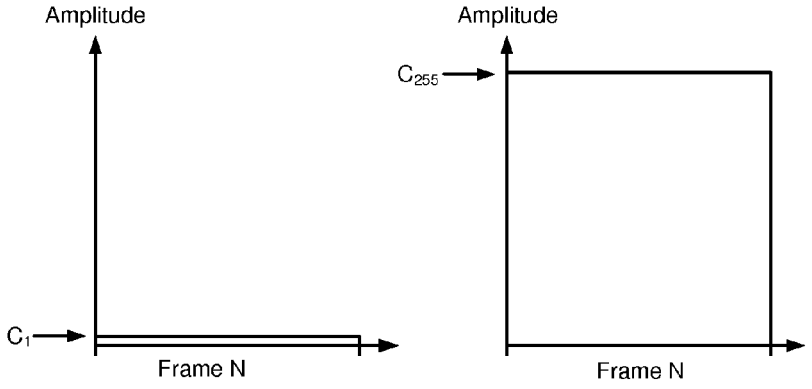
FIG. 2 shows the data signal applied to a cell of the AM-OLED for displaying two extreme grayscale levels in a classical way.
Figure 3:
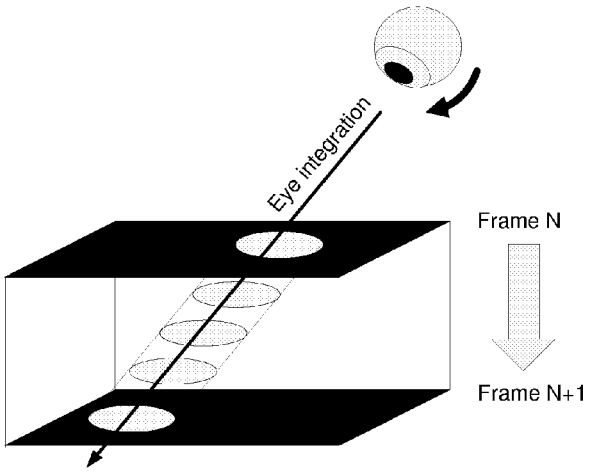
FIG. 3 illustrates the eye movement in the case of a moving object in a sequence of pictures.
Figure 4:
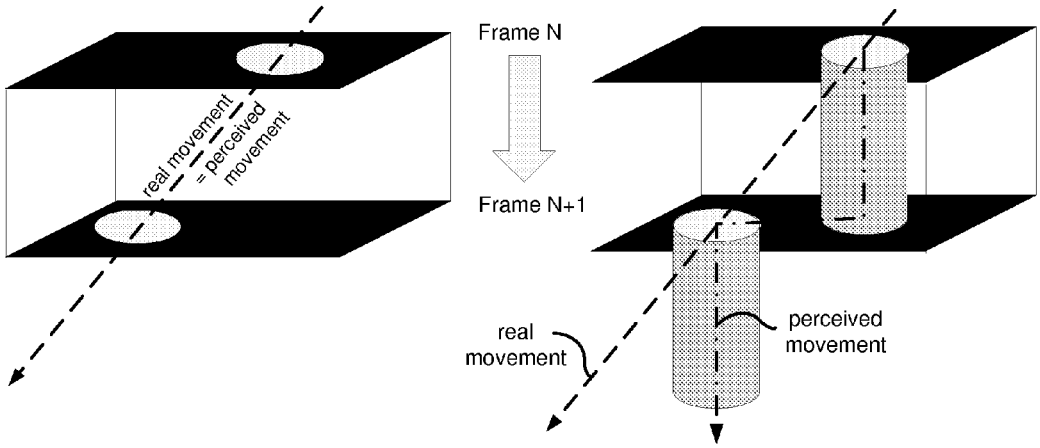
FIG. 4 illustrates the perceived movement of the moving object of FIG. 3 in the case of a CRT and an AM-OLED.
Figure 5:
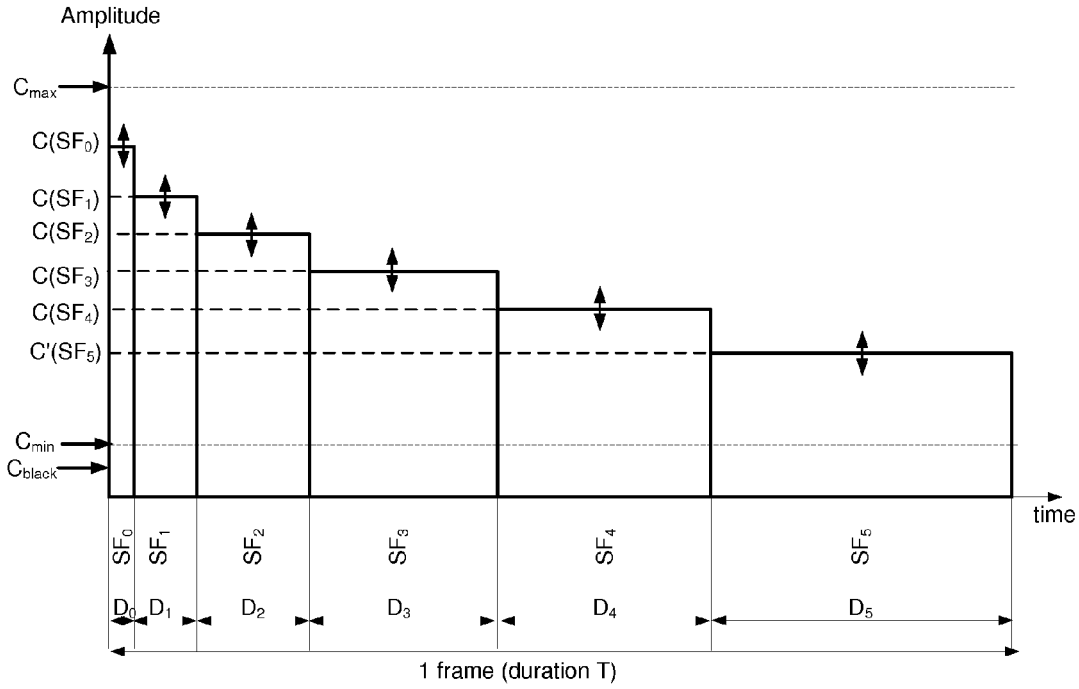
FIG. 5 shows a video frame comprising 6 sub-frames.
Figure 6:
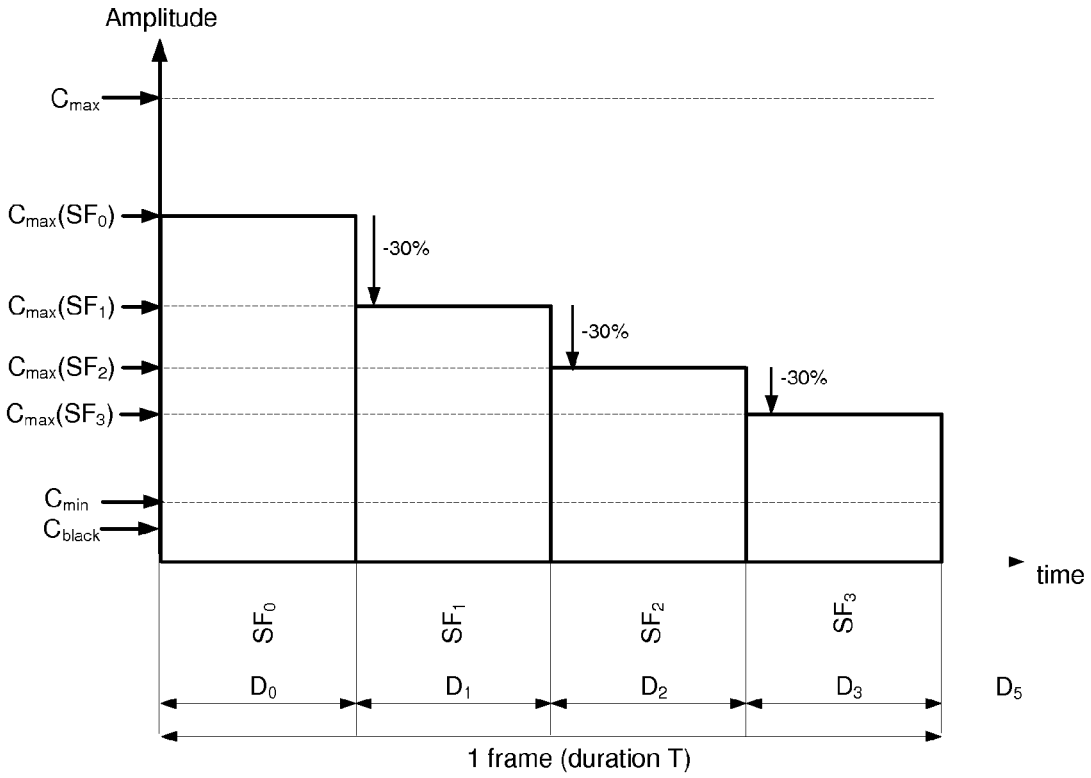
FIG. 6 shows a simplified video frame comprising 4 sub-frames.

In order to simplify the specification, we will take the example of a video frame built of 4 analog sub-frames $SF_0$ to $SF_3$ having the same duration $D_0=D_1=D_2=D_3=T/4$ using a voltage driven system. The reference voltages of each sub-frame are selected in order to have luminance differences of 30% between two consecutive sub-frames. This means that, at each sub-frame (every 5 ms) the reference voltages are updated according with the refresh of the cell for the given sub-frame. All values and numbers given here are only examples. These hypotheses are illustrated by FIG. 6. In practice, the number of sub-frames, their size and the amplitude differences are fully flexible and can be adjusted case by case depending on the application.

The invention will be explained in the case of a voltage driven system. In this case, the relation between the input video (input) and the luminance generated by the cell for said input video is a power of n, where n is close to 2. In case of current driven system, the relation between the input video (input) and the luminance generated by the cell for said input video is linear. It is equivalent to have n=1.

Therefore, in case of a voltage driven system, the luminance (Out) generated by a cell is for this example:

$$\text{Out} = \frac{1}{4} \times (X_0)^2 + \frac{1}{4} \times (0.7 \times X_1)^2 + \frac{1}{4} \times (0.49 \times X_2)^2 + \frac{1}{4} \times (0.343 \times X_3)^2$$

where $X_0$, $X_1$, $X_2$ and $X_3$ are sub-frame data (8-bit information linked to the video values) used for the four sub-frames $SF_0$, $SF_1$, $SF_2$ and $SF_3$.

In case of a current driven system, the luminance is $$\text{Out} = \frac{1}{4}\times(X_0) + \frac{1}{4}\times(0.7\times X_1) + \frac{1}{4}\times(0.49\times X_2) + \frac{1}{4}(0.343\times X_3)$$

This system enables to dispose of more bits as illustrated by the following example:

The maximum luminance is obtained for $X_0=255$, $X_1=255$, $X_2=255$ and $X_3=255$ which leads to an output luminance value of $$\text{Out} = \frac{1}{4}\times(255)^2 + \frac{1}{4}\times(0.7\times255)^2 + \frac{1}{4}\times(0.49\times255)^2 + \frac{1}{4}\times(0.343\times255)^2 = 30037.47 \text{ units}$$

The minimum luminance (without using the limit $C_{min}$) is obtained for $X_0=0$, $X_1=0$, $X_2=0$ and $X_3=1$ which leads to an output luminance value of $$\text{Out} = \frac{1}{4}\times(0)^2 + \frac{1}{4}\times(0.7\times0)^2 + \frac{1}{4}\times(0.49\times0)^2 + \frac{1}{4}\times(0.343\times1)^2 = 0.03 \text{ units}$$

With a standard display without analog sub-frames (or sub-fields) having the same maximum luminance, the minimum luminance would be equal to $$\left(\frac{1}{N}\right)^2\times30037.47$$

where N represents the bit depth. So for a 8-bit mode, the minimum luminance value is $$\left(\frac{1}{255}\right)^2\times30037.47 = 0.46$$

units, for a 9-bit mode, the minimum luminance value is $$\left(\frac{1}{512}\right)^2\times30037.47 = 0.11$$

units, and for a 10-bit mode, the minimum luminance value is $$\left(\frac{1}{1024}\right)^2\times30037.47 = 0.03$$

units.

This shows that the use of the analog sub-frames while simply based on 8-bit data drivers enables to generate increased bit-depth when sub-frame data related to a same video data can be different from said video data. However, the conversion of a video data into sub-frame data must be done carefully.

Indeed, in a standard system (no analog sub-frame or sub-field), half the input amplitude corresponds to fourth of the output amplitude since the relation input/output is following a quadratic curve in voltage driven mode. This has to be followed also while using an analog sub-field concept. In other words, if the input video value is half of the maximum available, the output value must be fourth of that obtained with $X_0=255$, $X_1=255$, $X_2=255$ and $X_3=255$. This can not be achieved simply with $X_0=128$, $X_1=128$, $X_2=128$ and $X_3=128$. Indeed, $$\text{Out} = \frac{1}{4}\times(128)^2 + \frac{1}{4}\times(0.7\times128)^2 + \frac{1}{4}\times(0.49\times128)^2 + \frac{1}{4}\times(0.343\times128)^2 = 7568.38$$

which is not 30037.47/4=7509.37. This is due to the fact that $(a+b+c+d)^2 \neq a^2+b^2+c^2+d^2$.

Consequently, a specific sub-frame encoding is used in order that the relation input/output follows a power of n, the value n depending on the display behaviour.

In the example of an input value of 128, the sub-frame data should be $X_0=141$, $X_1=114$, $X_2=107$ and $X_2=94$.

Indeed, $$\text{Out} = \frac{1}{4}\times(141)^2 + \frac{1}{4}\times(0.7\times114)^2 + \frac{1}{4}\times(0.49\times107)^2 + \frac{1}{4}\times(0.343\times94)^2 = 7509.37$$

which is exactly equal to 30037.47/4. Such an optimization is done for each possible input video level. This specific encoding is implemented by a Look-Up table (LUT) inside the display device. The number of inputs of this LUT depends on the bit depth to be rendered. In case of 8-bit, the LUT has 255 input levels and, for each input level, four 8-bit output levels (one per sub-frame) are stored in the LUT. In case of 10-bit, the LUT has 1024 input levels and, for each input level, four 8-bit outputs (one per sub-frame).

Now let us assume that we would like to have a display capable of rendering 10-bit material. In that case the output level should correspond to $$\left(\frac{X}{1024}\right)^2\times30037.47$$

where X is a 10-bit level growing from 1 to 1024 by a step of 1. Below, you can find an example of encoding table that could be accepted to render 10-bit in our example. This only an example and further optimization can be done depending on the display behavior:

TABLE 1

| 10-bit analog display | | Analog sub-frame encoding | | | | |
|---|---|---|---|---|---|---|
| Input video data X | Awaited Energy | Sub-frame data $X_0$ | Sub-frame data $X_1$ | Sub-frame data $X_2$ | Sub-frame data $X_3$ | Energy |
| 1 | 0.03 | 0 | 0 | 0 | 1 | 0.03 |
| 2 | 0.11 | 0 | 1 | 0 | 0 | 0.12 |
| 3 | 0.26 | 1 | 0 | 0 | 0 | 0.25 |
| 4 | 0.46 | 1 | 1 | 1 | 1 | 0.46 |
| 5 | 0.72 | 1 | 1 | 2 | 2 | 0.73 |
| 6 | 1.03 | 2 | 0 | 0 | 1 | 1.03 |
| 7 | 1.40 | 2 | 1 | 2 | 1 | 1.39 |
| 8 | 1.83 | 2 | 2 | 2 | 2 | 1.85 |
| 9 | 2.32 | 3 | 0 | 1 | 0 | 2.31 |
| 10 | 2.86 | 3 | 2 | 1 | 1 | 2.83 |
| 11 | 3.47 | 3 | 3 | 1 | 1 | 3.44 |
| 12 | 4.13 | 4 | 1 | 0 | 0 | 4.12 |
| 13 | 4.84 | 4 | 2 | 2 | 2 | 4.85 |
| 14 | 5.61 | 4 | 3 | 2 | 3 | 5.61 |
| 15 | 6.45 | 5 | 1 | 1 | 1 | 6.46 |
| 16 | 7.33 | 5 | 3 | 0 | 0 | 7.35 |
| 17 | 8.28 | 5 | 4 | 1 | 1 | 8.30 |
| 18 | 9.28 | 6 | 1 | 1 | 2 | 9.30 |
| 19 | 10.34 | 6 | 3 | 2 | 0 | 10.34 |
| 20 | 11.46 | 6 | 4 | 3 | 0 | 11.50 |
| 21 | 12.63 | 7 | 1 | 2 | 1 | 12.64 |
| 22 | 13.86 | 7 | 3 | 2 | 3 | 13.86 |
| 23 | 15.15 | 7 | 4 | 4 | 0 | 15.17 |
| 24 | 16.50 | 7 | 5 | 4 | 3 | 16.54 |
| ... | ... | ... | ... | ... | ... | ... |
| 512 | 7509.37 | 141 | 114 | 107 | 94 | 7509.37 |
| ... | ... | ... | ... | ... | ... | ... |
| 1024 | 30037.47 | 255 | 255 | 255 | 255 | 30037.47 |

The table 1 shows an example of a 10-bit encoding based on the preceding hypotheses. Several options can be used for the generation of the encoding table but it is preferable to follow at least one of these rules:

Minimize the error between the awaited energy and the displayed energy

The digital value Xi of the most significant sub-frame (with the highest value $C_{max}(SF_i)$) is growing with the input value.

Try to keep as much as possible the energy of $X_n \times C_{max}(SF_n) > X_{n+1} \times C_{max}(SF_{n+1})$.

Try to avoid to have $X_i=0$ if $X_{i-1}$ and $X_{i+1}$ are different from 0.

Figure 7:
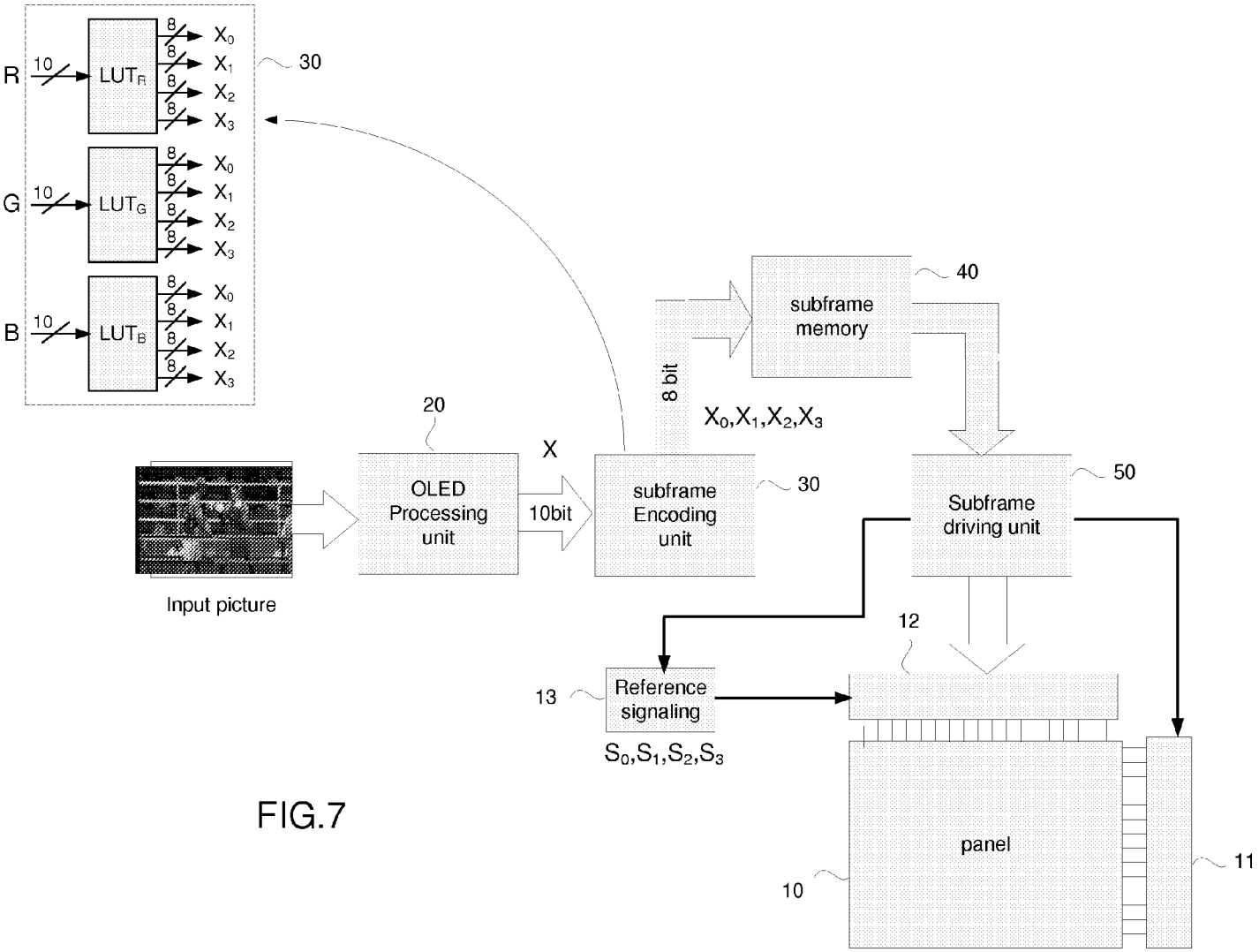
FIG. 7 shows a first display device comprising a sub-frame encoding unit delivering sub-frame data.

Try to reduce as much as possible the energy changes of each sub-frame when the video value are changing FIG. 7 illustrates a display device wherein video data are encoded into sub-frame data. The input video data of the pictures to be displayed that are for example 3×8 bit data (8 bit for red, 8 bit for green, 8 bit for green) are first processed by a standard OLED processing unit 20 used for example for applying a de-gamma function to the video data. Other processing operations can be made in this unit. For the sake of clarity, we will consider the data of only one color component. The data outputted by the processing unit are for example 10 bit data. These data are converted into sub-frame data by a sub-frame encoding unit 30. The unit 30 is for example a look-up table (LUT) or 3 LUTs (one for each color component) including the data of table 1. It delivers N sub-frame data for each input data, N being the number of sub-frames in a video frame. If the video frame comprises 4 sub-frames as illustrated by FIG. 6, each 10-bit video data is converted into four 8-bit sub-frame data as defined in table 1. Each 8-bit sub-frame data is associated to a sub-frame. The n sub-frame data of each pixel are then stored in a sub-frame memory 40, a specific area in the memory being allocated to each sub-frame. Preferably, the sub-frame memory is able to store the sub-frame data for 2 pictures. The data of one picture can be written in the memory while the data of the other picture are read. The sub-frame data are then read sub-frame by sub-frame and transmitted to a sub-frame driving unit 50. This unit controls the row driver 11 and the data driver 12 of the active matrix 10 and transmits the sub-frame data to the data driver 12. The data driver 12 converts the sub-frame data into sub-frame signals based on reference voltages or currents. An example of conversion of sub-frame data $X_i$ into a sub-frame signal based on reference signals is given in the table 2:

TABLE 2

| Sub-frame data $X_i$ | Sub-frame signal based on reference voltages |
|---|---|
| 0 | V 7 |
| 1 | V 7 + (V 6 − V 7) × 9/1175 |
| 2 | V 7 + (V 6 − V 7) × 32/1175 |
| 3 | V 7 + (V 6 − V 7) × 76/1175 |
| 4 | V 7 + (V 6 − V 7) × 141/1175 |
| 5 | V 7 + (V 6 − V 7) × 224/1175 |
| 6 | V 7 + (V 6 − V 7) × 321/1175 |
| 7 | V 7 + (V 6 − V 7) × 425/1175 |
| 8 | V 7 + (V 6 − V 7) × 529/1175 |
| 9 | V 7 + (V 6 − V 7) × 630/1175 |
| 10 | V 7 + (V 6 − V 7) × 727/1175 |
| 11 | V 7 + (V 6 − V 7) × 820/1175 |
| 12 | V 7 + (V 6 − V 7) × 910/1175 |
| 13 | V 7 + (V 6 − V 7) × 998/1175 |
| 14 | V 7 + (V 6 − V 7) × 1086/1175 |
| 15 | V 6 |
| 16 | V 6 + (V 5 − V 6) × 89/1097 |
| 17 | V 6 + (V 5 − V 6) × 173/1097 |
| 18 | V 6 + (V 5 − V 6) × 250/1097 |
| 19 | V 6 + (V 5 − V 6) × 320/1097 |
| 20 | V 6 + (V 5 − V 6) × 386/1097 |
| 21 | V 6 + (V 5 − V 6) × 451/1097 |
| 22 | V 6 + (V 5 − V 6) × 517/1097 |
| ... | ... |
| 250 | V 1 + (V 0 − V 1) × 2278/3029 |
| 251 | V 1 + (V 0 − V 1) × 2411/3029 |
| 252 | V 1 + (V 0 − V 1) × 2549/3029 |
| 253 | V 1 + (V 0 − V 1) × 2694/3029 |
| 254 | V 1 + (V 0 − V 1) × 2851/3029 |
| 255 | V 0 |

These sub-frame signals are then converted by data driver 12 into voltage or current signals to be applied to cells of the active matrix 10 selected by the row driver 11. The reference voltages or currents to be used by the data driver 12 are defined in a reference signaling unit 13. In case of a voltage driven device, the unit 13 delivers reference voltages and in case of a current driven device, it delivers reference currents. An example of reference voltages is given by the table 3:

TABLE 3

| Reference voltages | Voltage (Volts) |
|---|---|
| V 0 | 3 |
| V 1 | 2.6 |
| V 2 | 2.2 |
| V 3 | 1.4 |
| V 4 | 0.6 |
| V 5 | 0.3 |
| V 6 | 0.16 |
| V 7 | 0 |

The decrease of the maximal amplitude of the sub-frame data from the first sub-frame $SF_0$ to the fourth sub-frame $SF_3$ illustrated by FIG. 6 is obtained by decreasing the amplitude of the reference voltages used for a sub-frame $SF_i$ compared to those used for the sub-frame $SF_{i-1}$. For example, 4 sets of reference voltages S1, S2, S3 and S4 are defined in the reference signaling unit 13 and the set of reference voltages used by the data driver 12 is changed at each sub-frame of the video frame. The change of set of reference voltages is controlled by the sub-frame driving unit 50.

Figure 8:
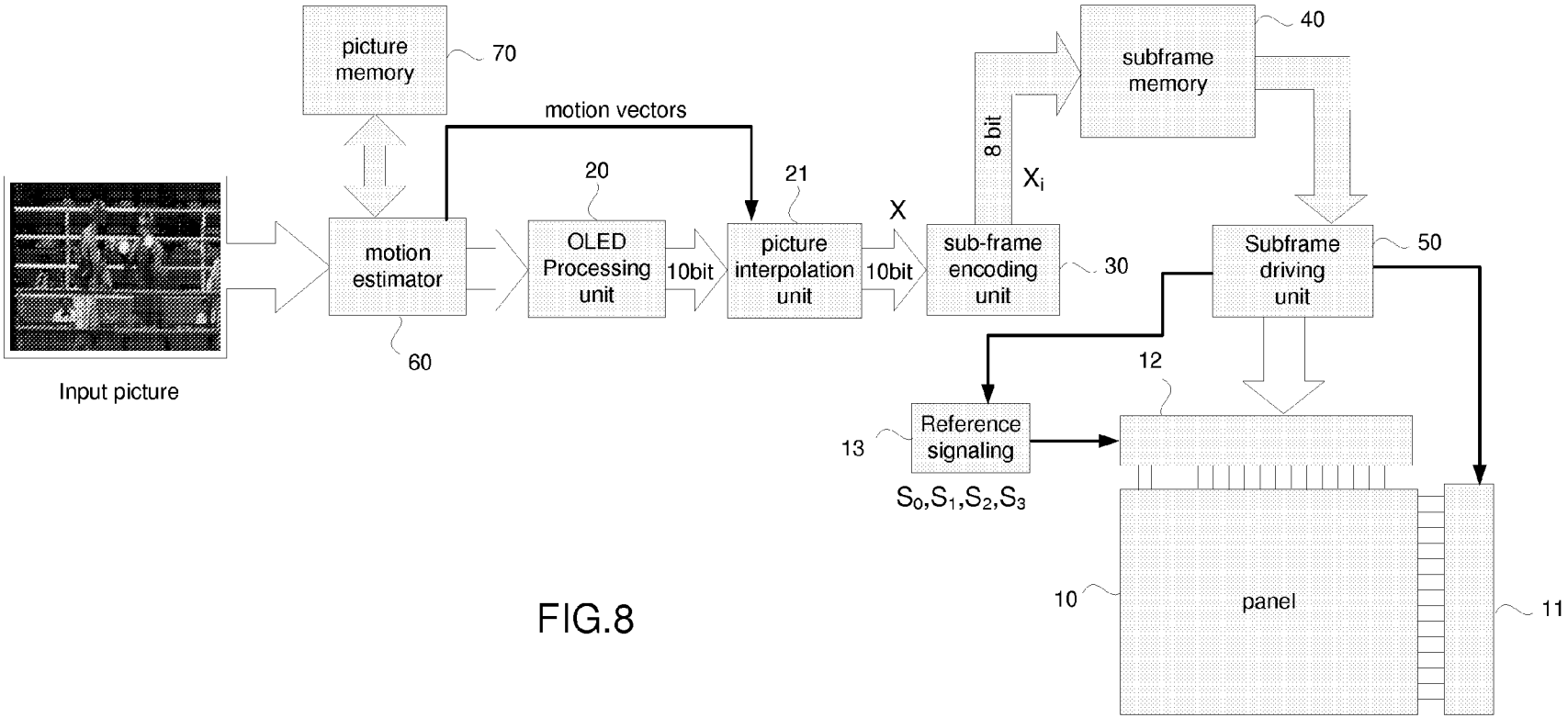
FIG. 8 shows a second display device wherein the sub-frame data are motion compensated.

Preferably, the sub-frame data stored in the sub-frame memory are motion compensated to reduce artifacts (motion blur, false contours, etc.). So a second display device illustrated by FIG. 8 wherein the sub-frame data are motion compensated. In addition to the elements of FIG. 7, it comprises a motion estimator 60 placed before the OLED processing unit 20, a picture memory 70 connected to the motion estimator for storing at least one picture and a picture interpolation unit 80 placed between the OLED processing unit 20 and the sub-frame encoding unit 30.

The principle is that each input picture is converted into a sequence of picture, each one corresponding to the time period of a given sub-frame of the video frame. In the present case (4 sub-frames), each input picture is converted by the picture interpolation unit 80 into 4 pictures, the first one being for example the original one and the three others being interpolated from the input picture and motion vectors by means well known from the man skilled in the art.

Figure 9:
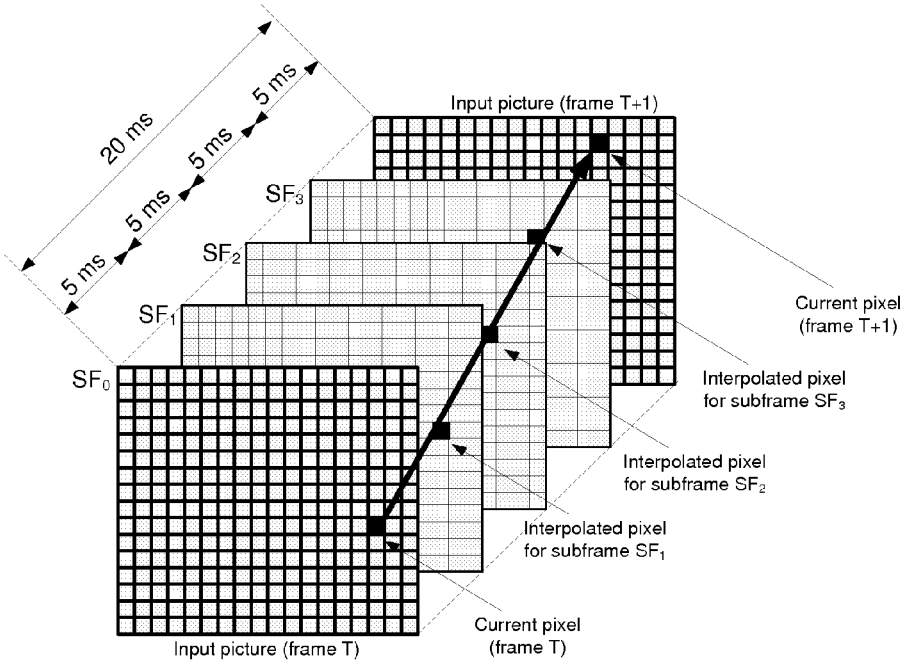
FIG. 9 illustrates the generation of interpolated pictures for different sub-frames of the video frame in the display device of FIG. 8, FIG. 10 to 13 illustrate different ways to associate input picture and interpolated pictures to sub-frames of a video frame.
Figure 10:
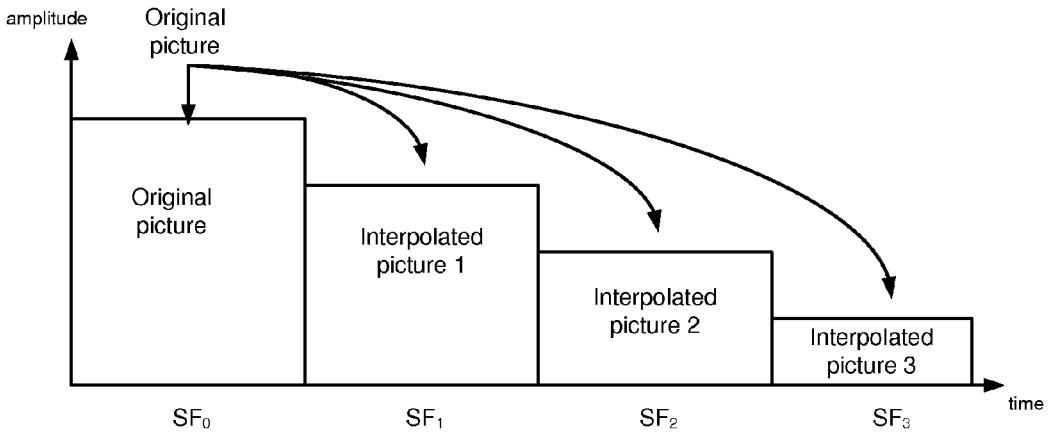
Figure 11:
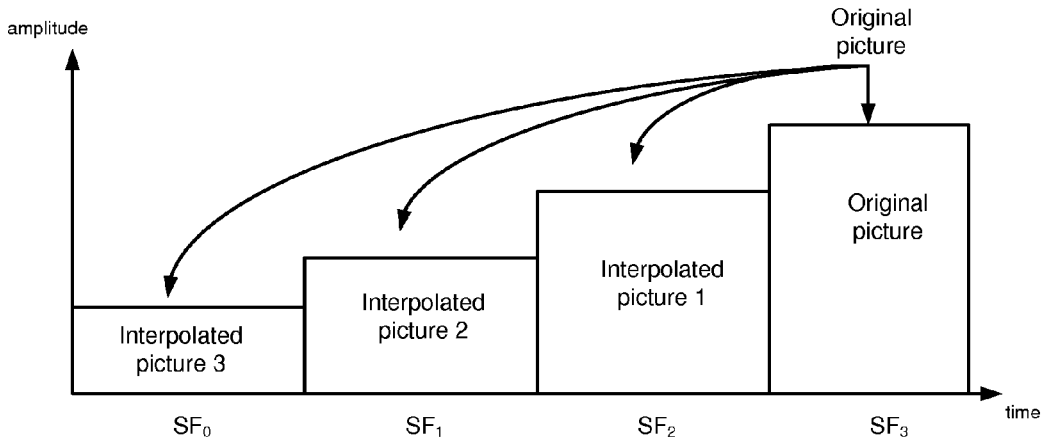
Figure 12:
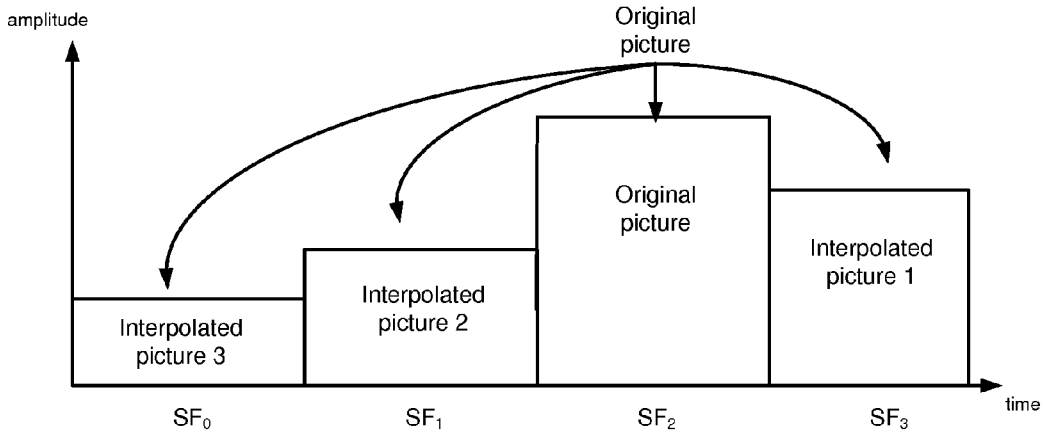
Figure 13:
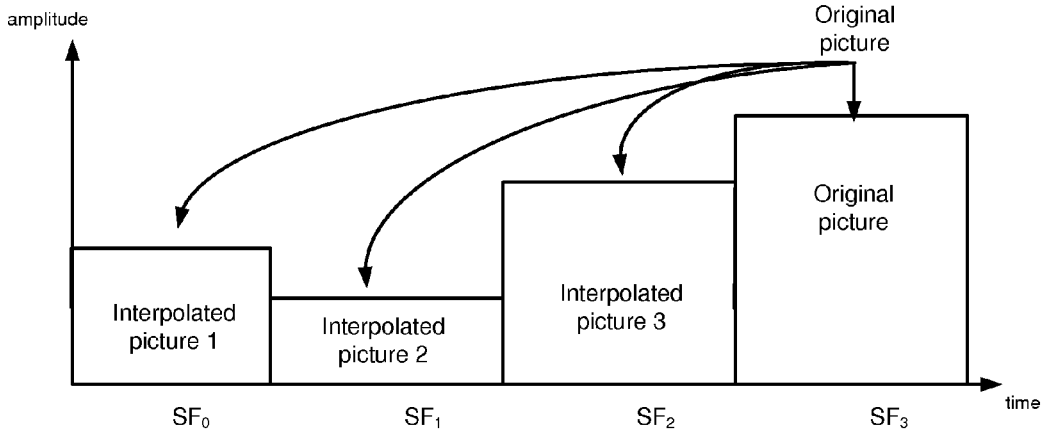

FIG. 9 shows one basic principle of motion compensated sub-frame data in 50 Hz. In this example, a motion vector is computed for a given pixel between a first input picture (frame T) and a second input picture (frame T+1) by the motion estimator 60. On this vector, three new pixels are interpolated representing intermediate video levels of the given pixel at intermediate time periods. Three interpolated pictures can be generated in this way. The input picture and the interpolated picture are then used for determining the sub-frame data. The input picture is used for generating the sub-frame data $X_0$, the first interpolated picture is used for generating the sub-frame data $X_1$, the second interpolated picture is used for generating the sub-frame data $X_2$ and the third interpolated picture is used for generating the sub-frame data $X_3$. The input picture can be displayed during a sub-frame different from the sub-frame $SF_0$. Advantageously, the input picture corresponds to the most luminous sub-frame (i.e the sub-frame having the highest duration and/or the highest maximal amplitude). Indeed, usually interpolated pictures are suffering from artifacts linked to the up-conversion algorithm selected. It is quite impossible to have artifact free up-conversion. Therefore, it is then important to reduce such artifacts by using the interpolated pictures for less luminous sub-frames.

FIGS. 10 to 13 illustrate different possibilities of associating the input picture and the interpolated pictures to the sub-frames of a video frame. The input is always associated to the most luminous sub-frame.

Figure 14:
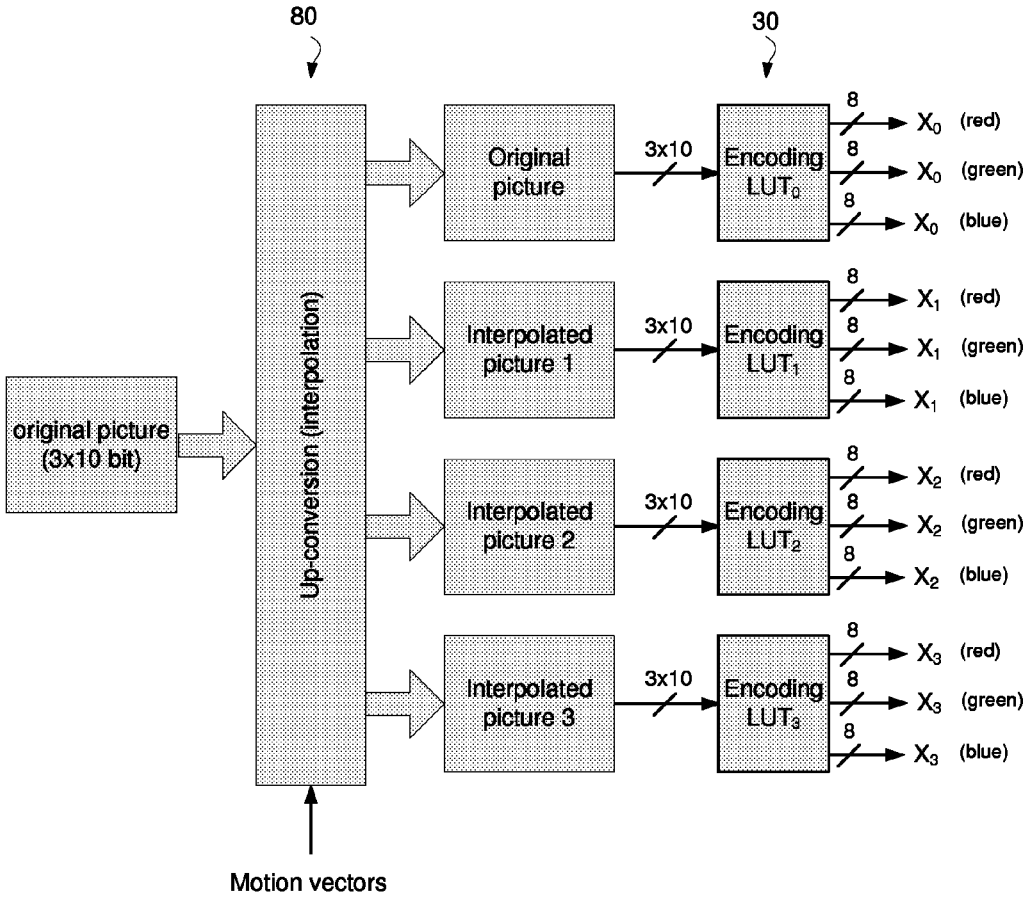
FIG. 14 illustrates the interpolation and sub-frame encoding operations in the display device of FIG. 8.

FIG. 14 illustrates the interpolation and the sub-frame encoding operations. The input picture is a 10-bit picture outputted by the OLED processing unit 20. This 10-bit input picture is converted into n 10-bit interpolated pictures (or sub-pictures), where n represents the amount of sub-frames. In the present case, the input picture is converted into 4 sub-pictures, the first one being the input picture and the three being interpolated pictures. Each sub-picture is forwarded to a separated encoding look-up table $LUT_i$ delivering, for each sub-picture, the appropriate sub-frame data $X_i$. Each encoding LUTi corresponds to a column Xi of the table 1. In the present case, the $LUT_0$ is used for the first sub-picture (input picture) and delivers subframe data $X_0$ (associated to sub-frame $SF_0$), the $LUT_1$ is used for the second sub-picture (first interpolated picture) and delivers subframe data $X_1$ (associated to sub-frame $SF_1$), the $LUT_2$ is used for the third sub-picture (second interpolated picture) and delivers subframe data $X_2$ (associated to sub-frame $SF_2$), and the $LUT_3$ is used for the fourth sub-picture (third interpolated picture) and delivers subframe data $X_3$ (associated to sub-frame $SF_3$). The sub-frame data delivered by the LUTs are coded in 8 bit and each LUT delivers data for the three color components.

What is claimed is:

1. An apparatus for displaying an input picture of a sequence of input pictures with increased bit depth on a display device during a video frame made up of a number of N consecutive sub-frames, with N≧2, comprising an active matrix comprising a plurality of light emitting cells, encoding means for encoding the video data of each pixel of the input picture to be displayed and delivering a number of N k-bit sub-frame data, with k≧8, each sub-frame data being displayed during a sub-frame, and a driving unit for selecting row by row the cells of said active matrix and converting, sub-frame by sub-frame, the sub-frame data delivered by said encoding means into signals to be applied to selected cells of the matrix, wherein the driving unit further comprises:

a sub-frame driving unit in communication with said encoding means; and a reference signaling unit in communication with said sub-frame driving unit and being configured to provide different reference signal sets used in a data driver which is in communication with said sub-frame driving unit for providing a change of the set of reference signals at each sub-frame of the video frame controlled by the sub-frame driving unit to display said input pictures with said encoding means converting said input pictures with increased bit depth into k-bit sub-frame data generating, with the sets of reference signals, the picture with increased bit depth so that at least one of the number of the N sub-frame data generated for a pixel is different from the video data of said pixel.

2. The apparatus according to claim 1, wherein the encoding means comprises at least one look-up table for encoding the video data of each pixel into a number of N sub-frame data and a sub-frame memory for storing said sub-frame data.

3. The apparatus according to claim 1, wherein the driving unit comprises a row driver for selecting row by row the cells of the active matrix;

said sub-frame driving unit for reading, sub-frame by sub-frame, the sub-frame data stored in a sub-frame memory and controlling the row driver; and a data driver for converting the sub-frame data read by the sub-frame driving unit into sub-frame signals and applying said sub-frame signals to the cells of the matrix selected by the row driver.

4. The apparatus according to claim 1, wherein the reference signaling unit is configured to deliver sets of reference signals to the data driver related to the sub-frame signals to be applied to the cells for generating, with the sets of reference signals, the picture with increased bit depth.

5. The apparatus according to claim 4, wherein the reference signals change at each sub-frame within the video frame.

6. The apparatus according to claim 5, wherein the reference signals are decreasing from the first sub-frame to the last sub-frame within the video frame.

7. The apparatus according to claim 5, wherein the reference signals are increasing from the first sub-frame to the last sub-frame within the video frame.

8. The apparatus according to claim 5, wherein, within the video frame, the reference signals are increasing from the first sub-frame to an intermediate sub-frame and decreasing from said intermediate sub-frame to the last sub-frame, said intermediate sub-frame being different from the first and the last sub-frames.

9. The apparatus according to claim 5, wherein, within the video frame, the reference signals are decreasing from the first sub-frame to an intermediate sub-frame and increasing from said intermediate sub-frame to the last sub-frame, said intermediate sub-frame being different from the first and the last sub-frames.

10. The apparatus according to claim 1 further comprising a motion estimator for computing a motion vector for each pixel of the input picture to be displayed during a current video frame, said motion vector being representative of the motion of said pixel between the current video frame and a next video frame, and an interpolation unit for computing, for each input picture, a number of N−1 interpolated pictures based on the motion vectors computed for said input picture, wherein the video data of each pixel of said input picture and interpolated pictures are encoded by the encoding means (40) into a number of N sub-frame data, each sub-frame data being derived from one of said input picture and interpolated pictures.

* * * * *